US007892027B2

(12) United States Patent
Mao et al.

(10) Patent No.: US 7,892,027 B2
(45) Date of Patent: Feb. 22, 2011

(54) MULTIPORT RECEPTACLE CONNECTOR HAVING EMI SHELL INTERLOCKED TO PARTITIONING WALL FOR PREVENTING WARPAGE

(75) Inventors: Yu-Hua Mao, KunShan (CN); Zhi-Hong Fang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/549,404

(22) Filed: Aug. 28, 2009

(65) Prior Publication Data

US 2010/0062653 A1 Mar. 11, 2010

(30) Foreign Application Priority Data

Sep. 9, 2008 (CN) ..... 2008 1 0195986

(51) Int. Cl.
*H01R 13/648* (2006.01)

(52) U.S. Cl. ..... 439/607.25; 439/607.56

(58) Field of Classification Search ..... 439/607.25, 439/607.23, 607.26, 607.53, 56, 79
See application file for complete search history.

(56) References Cited

U.S. PATENT DOCUMENTS 5,480,326 A * 1/1996 Chen ..... 439/607.23
5,775,946 A * 7/1998 Briones ..... 439/607.25
6,629,859 B2 * 10/2003 Hoshino et al. ..... 439/607.25
6,755,691 B2 6/2004 Sasame et al.
6,939,177 B2 9/2005 Kato et al.
7,121,886 B1 * 10/2006 Liu ..... 439/607.26
7,241,174 B2 * 7/2007 Tsai ..... 439/607.25
7,690,947 B2 * 4/2010 Gu et al. ..... 439/607.23

* cited by examiner

*Primary Examiner*—Gary F. Paumen
(74) *Attorney, Agent, or Firm*—Andrew C. Chenge; Wei Te Chung; Ming Chieh Chang

(57) ABSTRACT

A receptacle connector comprising an insulative housing having a base portion; a plurality of terminals retained in the insulative housing; and a shielding shell assembled on the insulative housing. The shielding shell comprises a pair of sidewalls opposite to each other and forming a mating cavity therebetween. The insulative housing further including an alignment wall extending into the mating cavity from the base portion to partition the mating cavity into a number of mating openings, one of the mating opening having a shape different from another. Wherein at least one of the sidewalls has a bent portion bent from a front edge thereof, and the bent portion defines a hook at the tip thereof for adapting to retention at least one hole of the alignment wall of the insulative housing. Therefore, the strength of the receptacle connector may be improved.

20 Claims, 11 Drawing Sheets

MULTIPORT RECEPTACLE CONNECTOR HAVING EMI SHELL INTERLOCKED TO PARTITIONING WALL FOR PREVENTING WARPAGE

BACKGROUND OF THE INVENTION

1. Field of the Invention

The present invention relates to a receptacle connector, especially to a receptacle connector having EMI shell having anchors interlocked to partition wall so as to prevent the shell from warpage.

2. Description of the Related Art

Portable computer, lap top computer have become quite popular in recent years, and a connecting system is therefore necessary between the lap top computer and peripheral device such as display. This connecting system like a docking station includes a cable having one end with one connector usually connecting to a docking connector of the lap top and another end with various connectors connecting to the peripheral device. One of the various connectors may typically be HDMI (High Definition Multimedia Interface), USB, IEEE1394 or display port connector and others.

HDMI is popular interface in recent years by virtue of its advantage. HDMI connector of peripheral device can mate with corresponding connector on the docking station and transfer HDMI signals through the docking connector on the lap top computer. For example, a peripheral device having an HDMI interface can interconnect with the laptop computer by an HDMI cable assembly or the docking station. So, a popular connector is used frequently and there is a need the popular connector such as HDMI connector can be used without the docking station, and there is another requirement that it is not increase manufacture cost of the lap top computer, but also make a user convenient in a certain case.

Therefore, an improved receptacle connector is desired to overcome the disadvantages of the related arts.

BRIEF SUMMARY OF THE INVENTION

An object of the present invention is to provide a electrical connector assembly with improving strength thereof.

In order to achieve above-mentioned object, An connector assembly comprising: an receptacle connector including an insulative housing having a base portion; a plurality of terminals retained in the insulative housing; and a metal unit assembled on the insulative housing. The metal unit comprises a pair of sidewalls opposite to each other and forming a mating cavity therebetween. The insulative housing further including an alignment wall extending into the mating cavity from the base portion to partition the mating cavity into a number of mating openings, one of the mating openings having a shape different from another. wherein at least one of the sidewalls of the metal unit has an interlock extending from a front edge thereof to engage with the alignment wall of the insulative housing. Therefore, the strength of the electrical connector assembly may be improved.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
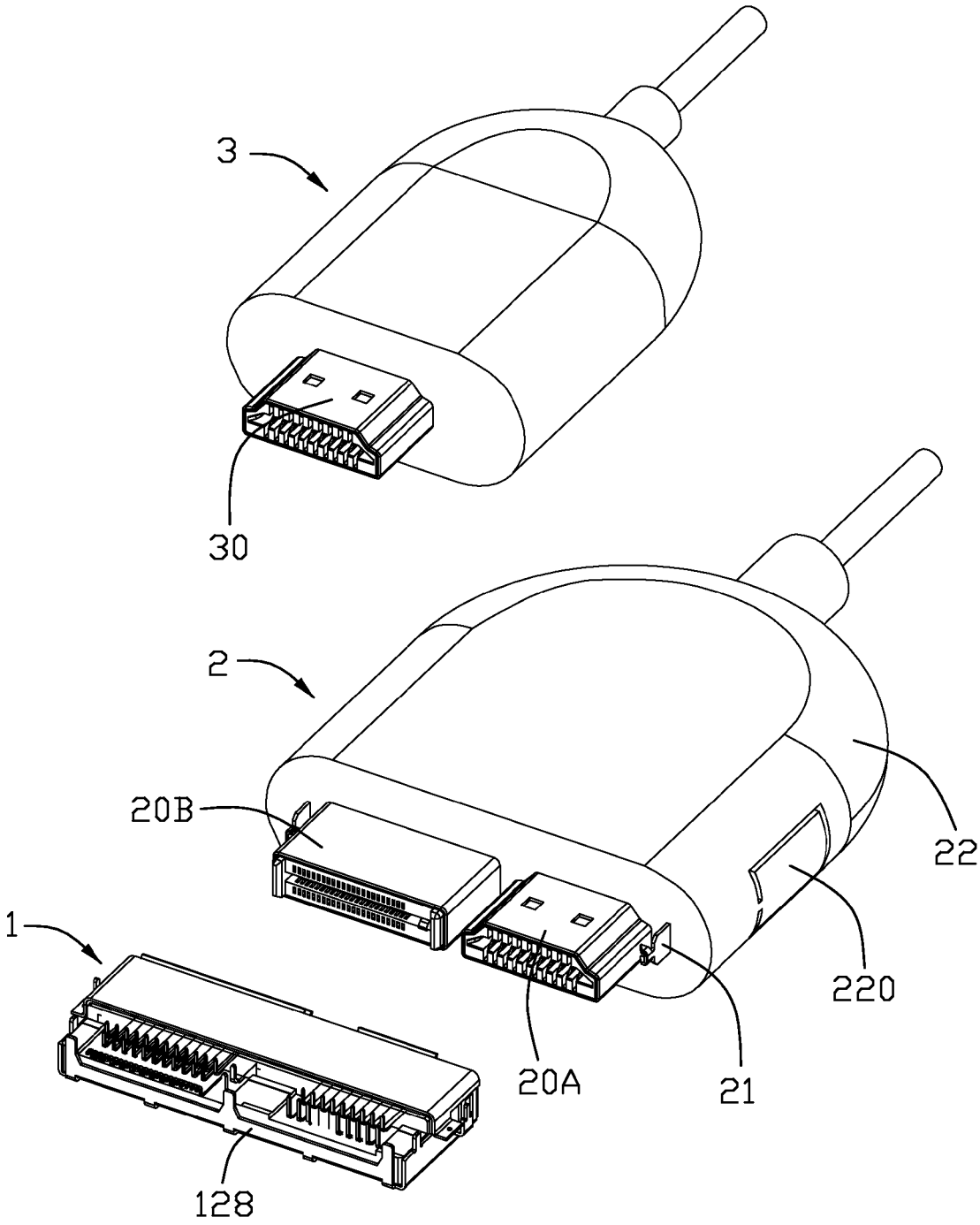
FIG. 1 is a perspective view of a first embodiment made in accordance with the present invention in which a receptacle connector having a pair of interfaces which can alternatively receive a cable connector incorporated a single connector or a cable connector with two different connectors therein are described.

Reference will now be made to the drawing figures to describe the preferred embodiments of the present invention in detail.

Figure 2:
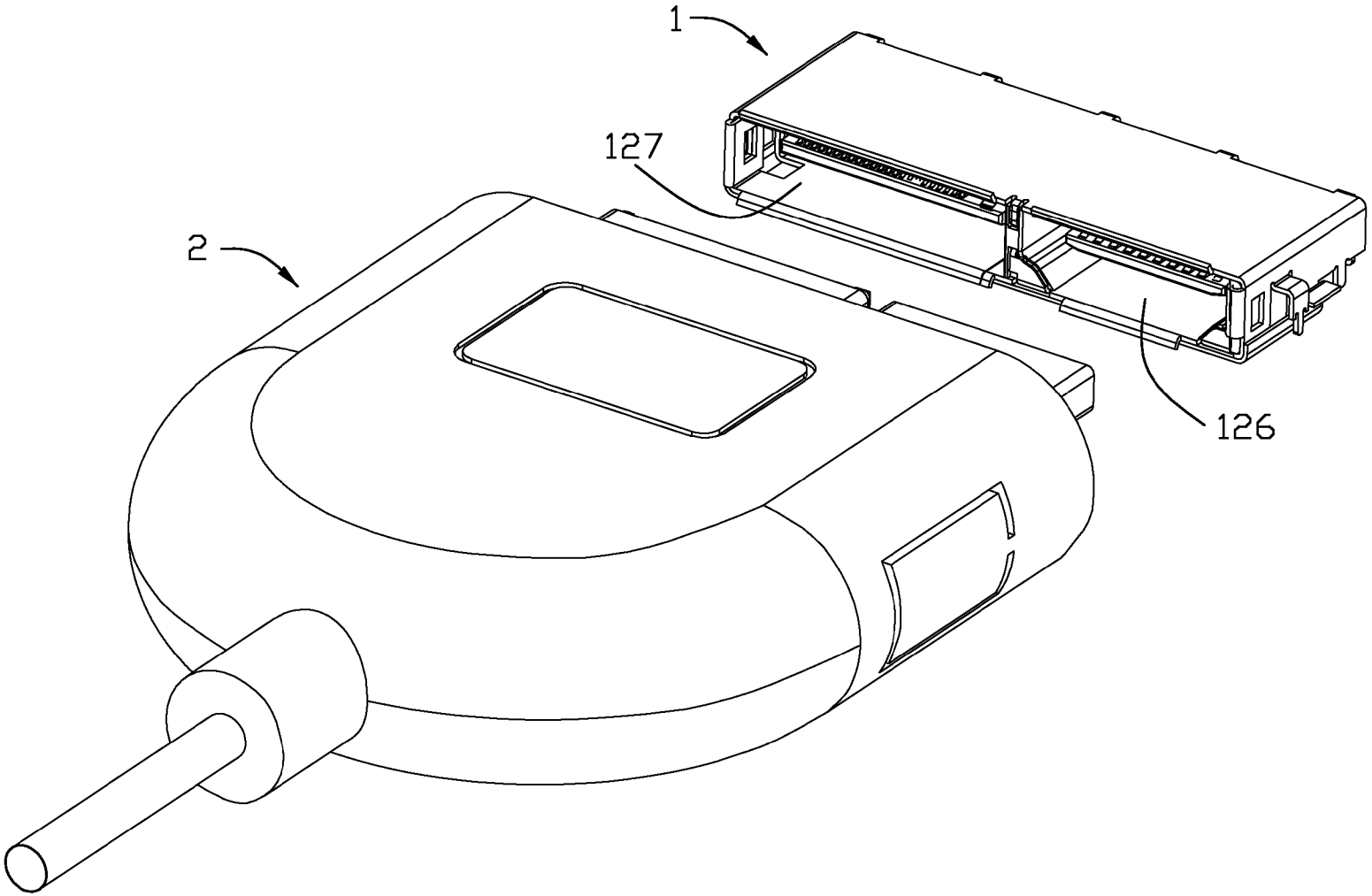
FIG. 2 is an illusration showing the receptacle connector is mating with a cable connector with two different interfaces.

Referring to FIGS. 1 to 2, a receptacle connector 1 made in accordance with the present invention includes first and second mating openings 126 and 127 to interconnect with a first cable connector 2 having an HDMI interface 20A and another interface 20B, or alternatively, a second cable connector 3 having an HDMI interface 30.

Figure 3:
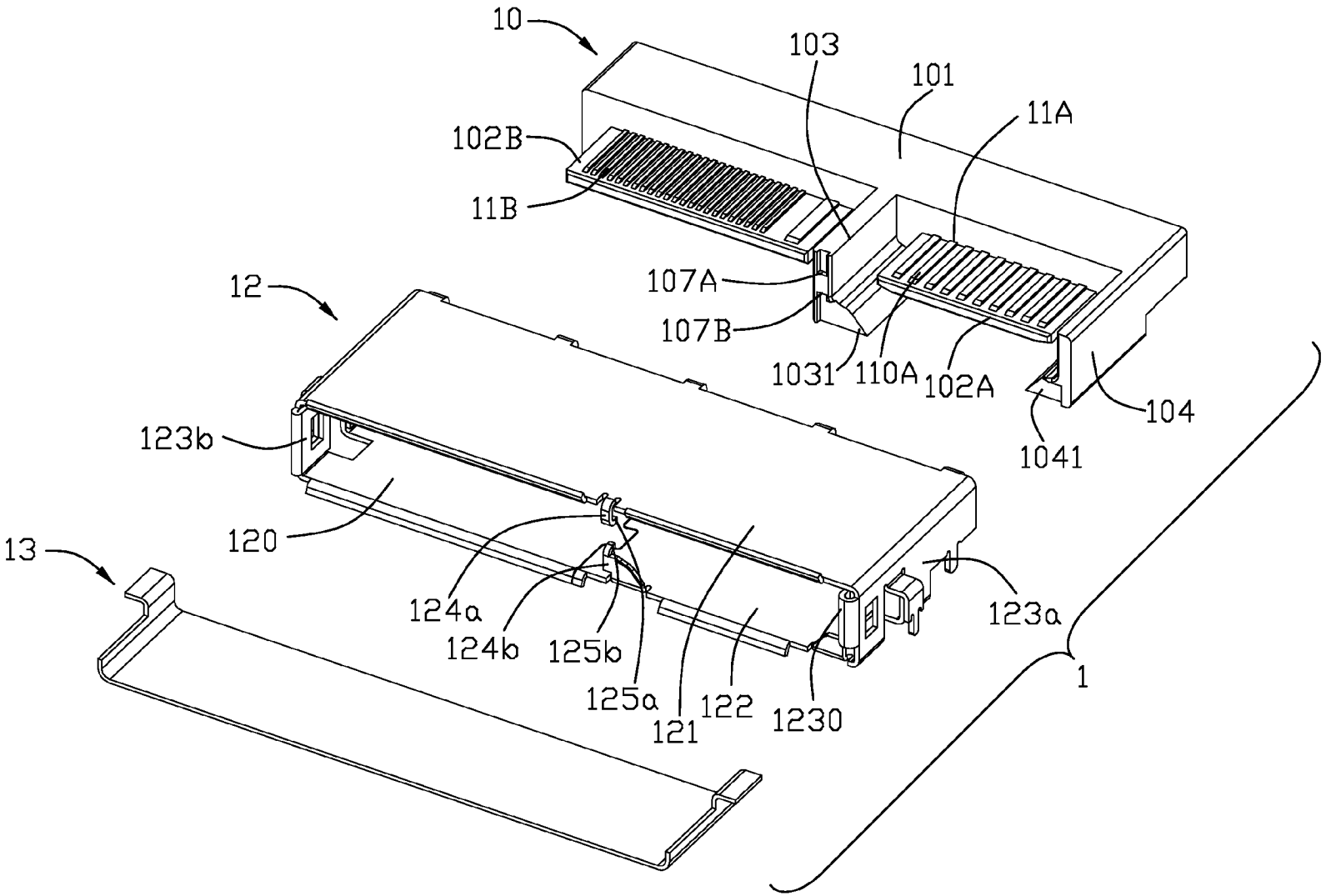
FIG. 3 is an exploded view of the receptacle connector shown in FIG. 1.
Figure 4:
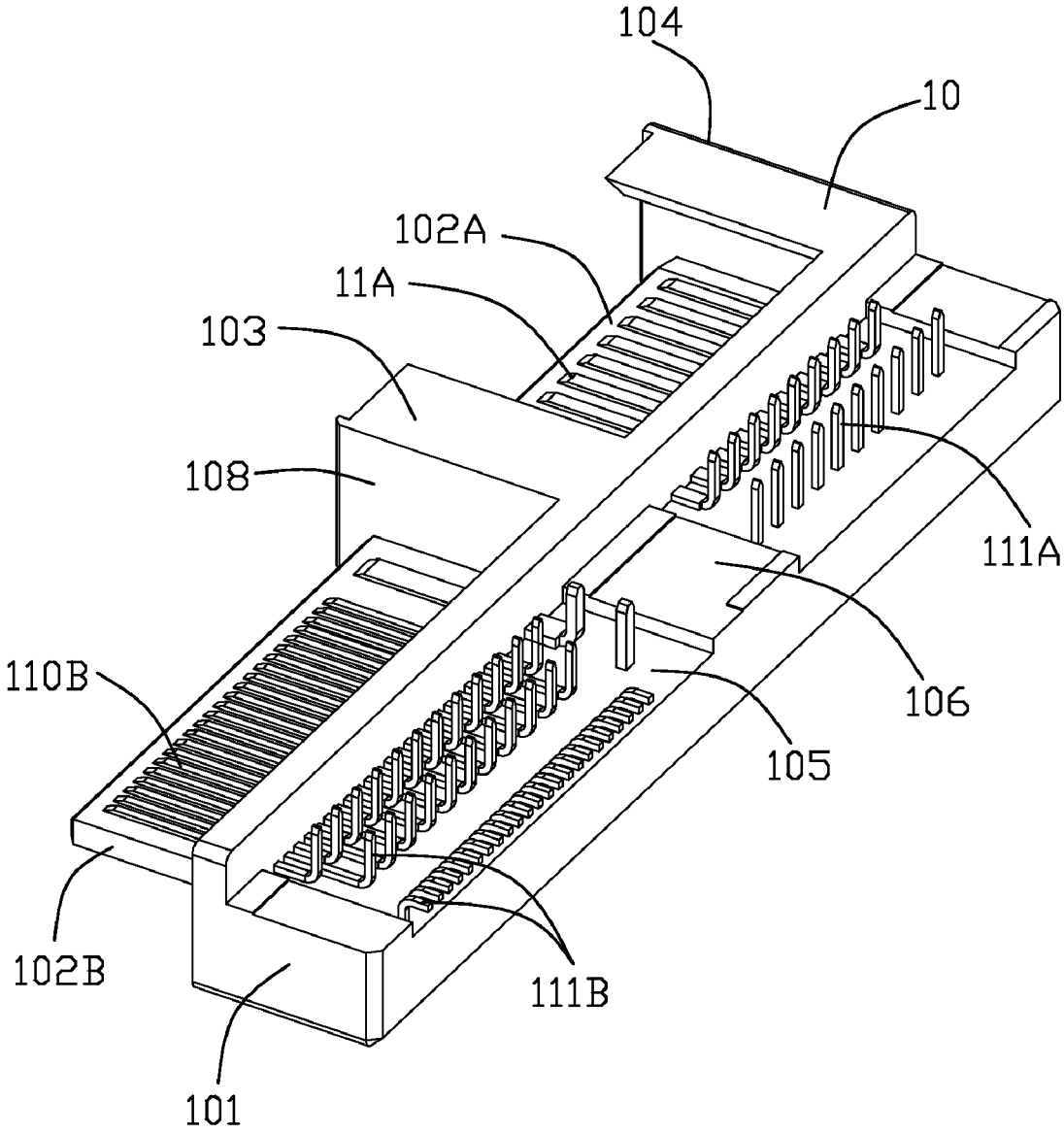
FIG. 4 is a rear and bottom view of the receptacle connector with a shielding shell and supporting bracket removed therefrom.

Referring to FIGS. 3 to 4, the receptacle connector 1 includes an insulative housing 10, a plurality of first terminals 11A and second terminals 11B retained in the insulative housing 10, a shielding shell 12 covering the insulative housing 10 and a supporting bracket 13 attached to the shielding shell 12, the shielding shell 12 and the supporting bracket 13 are made of conductive material.

The insulative housing 10 is provided with a base portion 101, a first tongue portion 102A, a second tongue portion 102B and an alignment wall 103 forward extending from the base portion 101, respectively. The alignment wall 103 is located between and perpendicular to the first tongue portions 102A and the second tongue portion 102B, and the alignment wall is providing a robust guiding arrangement when both connector are mating. The base portion 101 has a concavity 105 at rear bottom thereof, thereby a mounting surface 106 for mounting on the PCB 100 (shown in FIG. 9) is higher than the bottom of the base portion 101 to reduce the thickness of the receptacle connector on the PCB. The alignment wall 103 and the base portion 101 are on a same level at their top face. Each of the tongue portions 102A, 102B is provided with the first terminals 11A and the second teminals 11B with different pitch arrangements, respectively, and each of the first and second terminals is formed with retaining portions secured to the base portion 101 of the insulative housing 10, and further includes a contact portion 110A, 110B extending forward from one end of the retaining portion along a corresponding passageway of the tongue portion 102A,102B and a solder portion 111A,111B extending backward from another end of the retaining portion beyond the mounting surface 106 of the insulative housing 10 for connecting with PCB.

With referring to FIGS. 3, 5and 7, the shielding shell 12 is assembled on the insulative housing 10 for preventing the receptacle connector from EMI (Electro Magnetic Interference). The shielding shell 12 defines an upper sidewall 121, lower sidewall 122 and a pair of endwalls 123*a*, 123*b* interconnecting with the upper and lower sidewalls 121,122 thereby forming a mating cavity 120 thereamong. A pair of bent portions 124*a*, 124*b* bent from a front edge of the upper sidewall 121 and lower sidewall 122 respectively, and the alignment wall 103 defines a pair of holes 107A,107B for receiving hooks 125*a*, 125*b* of the bent portion 124*a*, 124*b* of the shielding shell 12 so that the upper sidewall 121 and the lower sidewall 122 of the shielding shell 12 can be prevented from being humped up and increase strength of the receptacle connector.

Figure 5:
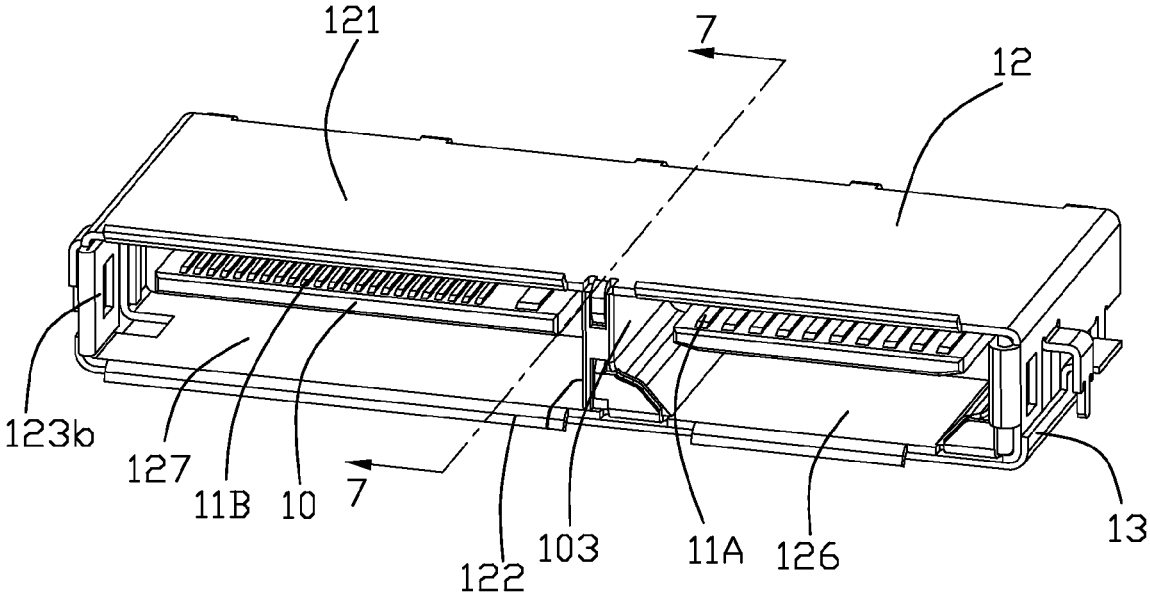
FIG. 5 is a perspective view of an assembled receptacle connector.

Further referring to FIGS. 1, 3 and 5, it is noted that the alignment wall 103 of the insulative housing 10 extending into the mating cavity 120 from the base portion 101 to partition the mating cavity 120 into two mating openings 126 and 127, and one of the mating opening having a shape different from another. In the embodiment shown in the figures, the mating opening 126 is formed to a HDMI (High Definition Multimedia Interface) opening for connecting with the HDMI interface 30 of the second cable connector 3 or said pair of different interfaces of the second cable connector 2. That is, the popular HDMI interface 3 of the second cable connector 3 can be directly inserted into the receptacle connector 1. Alternatively, the receptacle connector 1 can be inserted with the first cable connector having said HDMI interface 20A and another interface 20B. So with this construction, the receptacle connector can be used efficiently. In preferred embodiment, the mating opening 127 is for a docking station so that the receptacle connector 1 is still connecting with a docking station to expand different interfaces.

Figure 8:
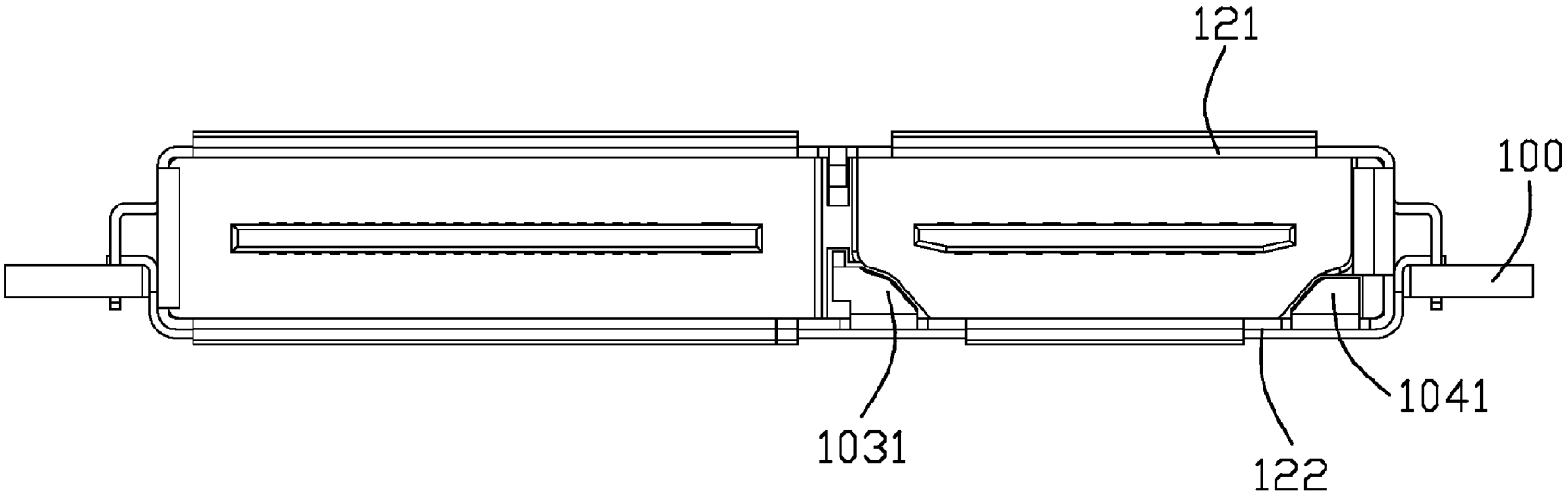
FIG. 8 is a front elevational view of the receptacle connector shown in FIG. 5, with the receptacle connector mounted on the Printed Circuit Board (PCB)

The insulative housing further defines an endwall 104 at outmost end of the base portion 101, which is opposite to the alignment wall 103, and the shielding shell 12 defines a retention wall 1230 extending from a front edge of the endwall 123*a* of the shielding shell 12. The endwall 104 and the alignment wall 103 each protrude a slant portion 1041, 1031 into the mating opening 126 to form said HDMI opening. A first side-face 108 (shown in FIG. 4) opposite to the HDMI opening, of the alignment wall 103 cooperates with one endwall 123*b* of the shell to form said mating opening 127. The upper sidewall 121 and the lower sidewall 122 of the shielding shell 12 serve as a upper side and a lower side of the mating opening 126, 127 respectively, thereby the thickness of the receptacle connector 1 can be made even thinner(shown in FIG. 8). A rear portion 128 of the upper wall 121 of the shielding shell 12 is bent down immediate to the base portion 101 of the insulative housing 10 for preventing the receptacle connector from EMI (see FIG. 1).

Figure 6:
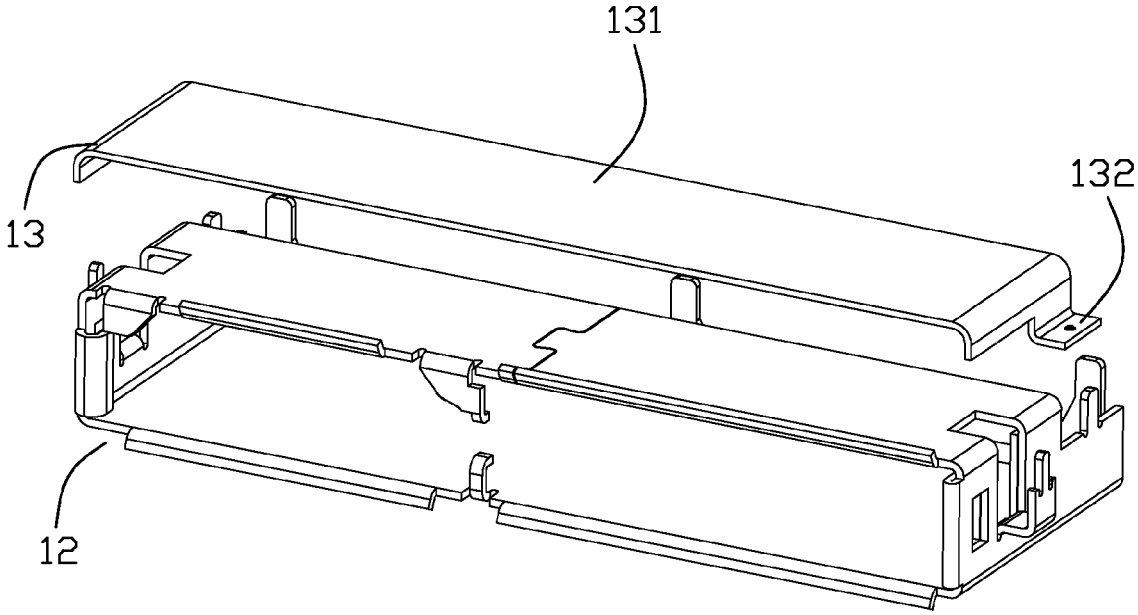
FIG. 6 is a perspective view of the shielding shell and the supporting bracket viewing from a bottom thereof.
Figure 7:
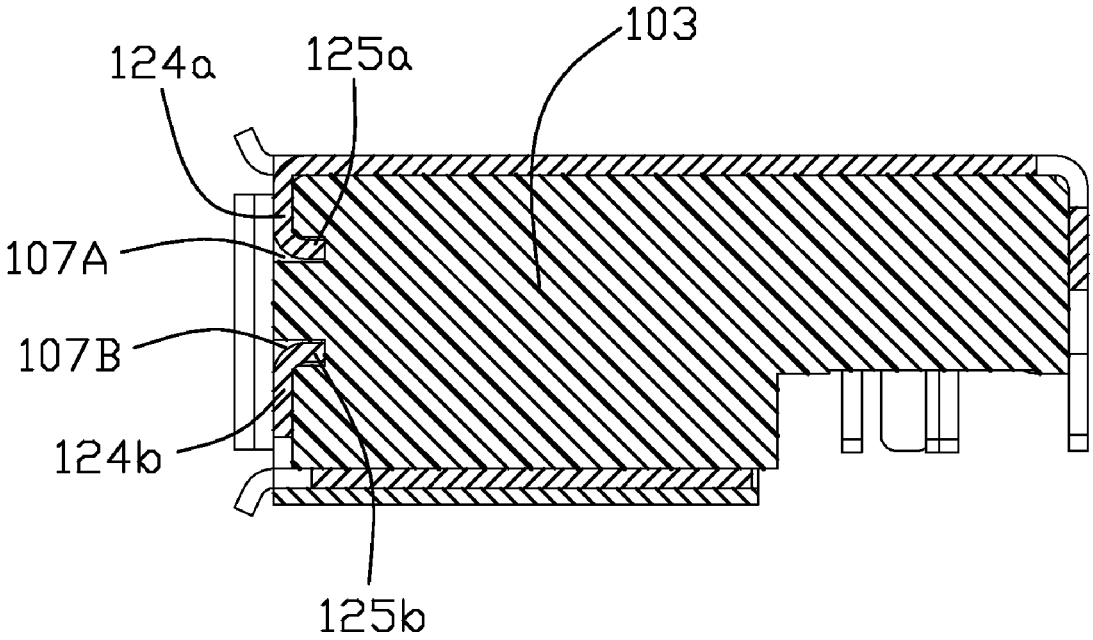
FIG. 7 is a cross-section view taken along a line 7-7 in FIG. 5.
Figure 9:
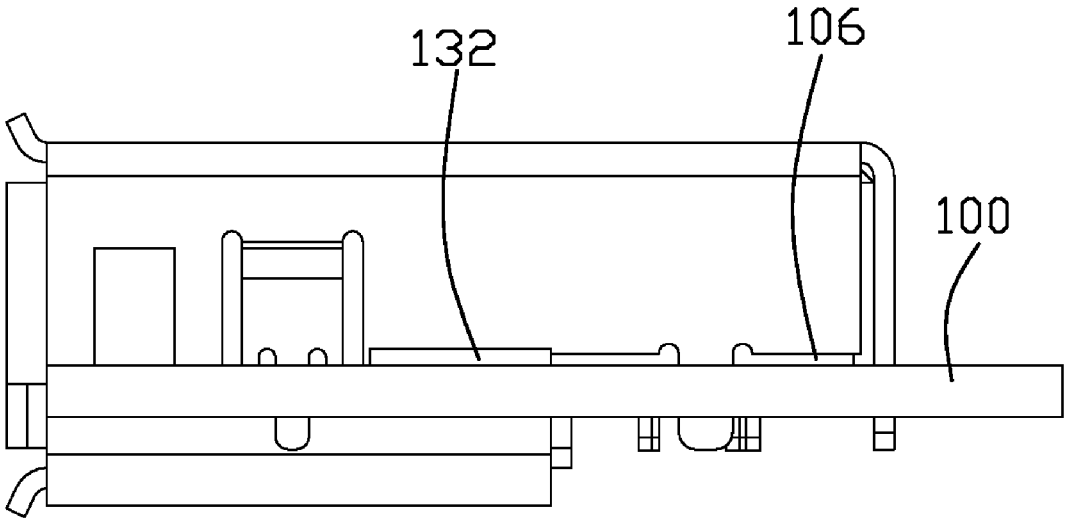
FIG. 9 is a side view of the receptacle connector with the PCB shown in FIG. 8.

With referring to FIGS. 6 and 9, the supporting bracket 13 attached one sidewall of the shielding shell 12 by spot soldering so as to provide a steady connecting therebetween. Said structure would improve the strength of the mating cavity 120 of the receptacle connector 1. The supporting bracket 13 has a main portion 131 attached the shielding shell 12 and a pair of soldering portions 132 extending from two ends of the main portion 131, and there is a wonderful coplanarity between the soldering portion 132 of the supporting bracket 13 and the mounting surface 106 of the insulative housing 10 so that all of them can be reliably soldered to the PCB.

Return to FIGS. 1 and 2, the first cable connector 2 further including a cover 22 retained to the HDMI interface 20A and another interface 20B and a pair of locking arms 21 arranged on both sides of the two interfaces 20A, 20B of the first cable connector 2 so as to securely interlock the receptacle connector 1 after mated. Corresponding to the pair of locking arms 21, the cover 22 defines a pair of buttons 220 on both sides thereof for unlocking the receptacle connector. And each of the buttons 220 is formed by cutting a C-shape slit on both sides of the cover 22, and a cutting opening of the C-shape slit defines toward the receptacle connector 1 thereby improving the arm of force of locking arm 21.

Figure 10:
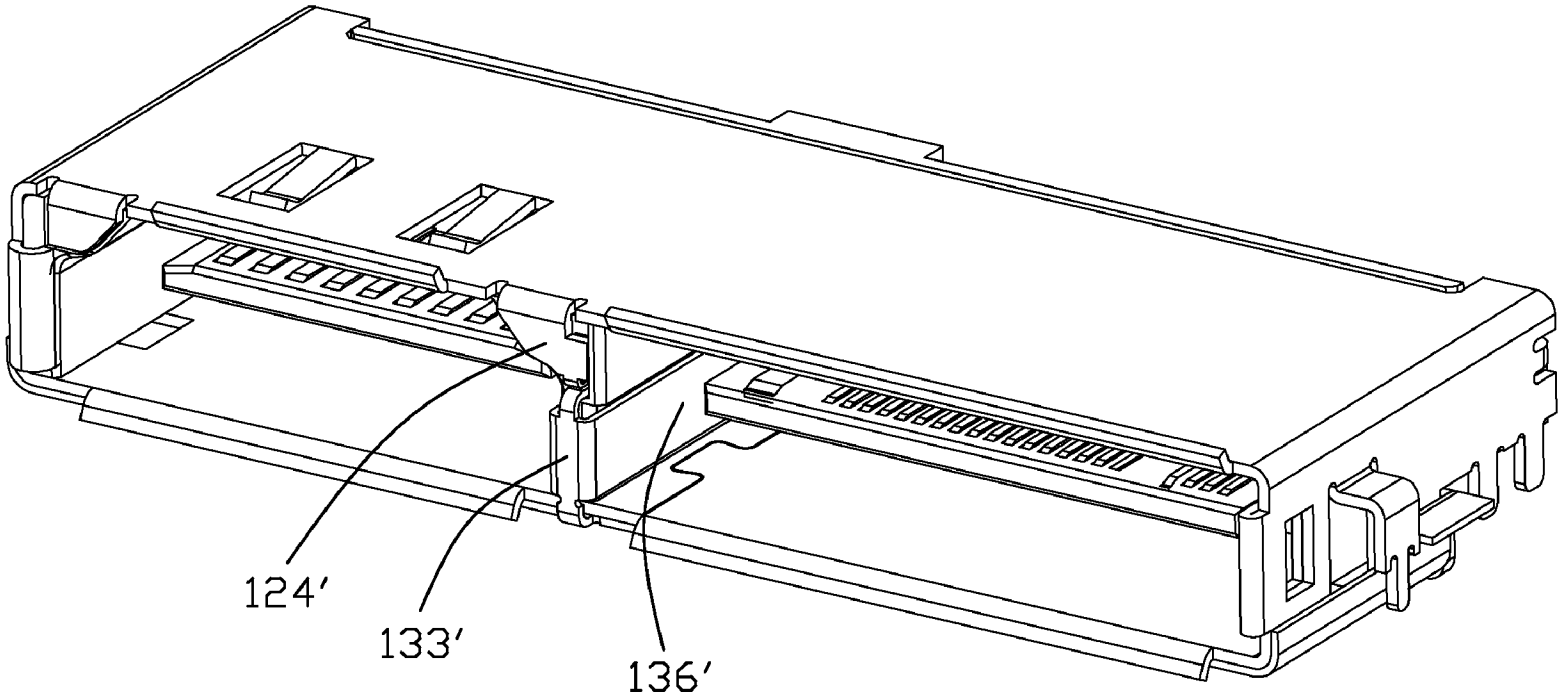
FIG. 10 is a perspective view of an receptacle connector in accordance with a second embodiment of the present invention.
Figure 11:
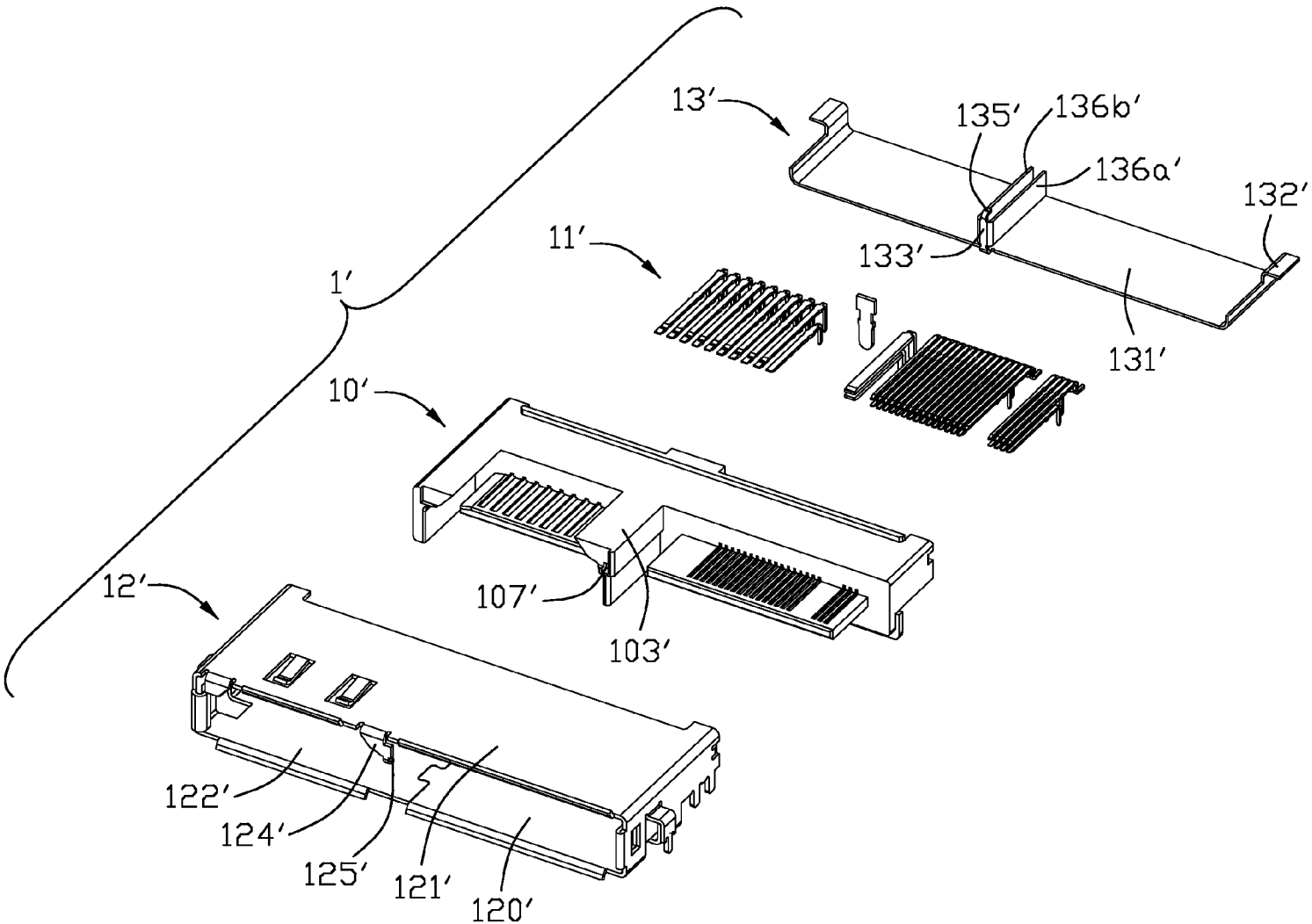
FIG. 11 is an exploded view of the receptacle connector shown in FIG. 10.

Referring FIGS. 10 to 11, an receptacle connector 1' of a second embodiment of the present invention is shown, and shows a modification of the receptacle connector 1 illustrated in FIG. 5. The receptacle connector 1' comprises an insulative housing 10', a plurality of terminals 11', a shielding shell 12' and a supporting bracket 13', similar to the above first embodiment except the shielding shell 12' and the supporting bracket 13'.

The shielding shell 12' defines a upper sidewall 121' with a bent portion 124' extending from a front edge thereof and a lower sidewall 122' and formed a mating cavity 120' therebetween, the supporting bracket 13' comprises a main portion 131' attached to the shielding shell 12' and a pair of soldering portions 132' extending from two ends thereof, and the supporting bracket 13' further defines a bent portion 133' extending from a front edge thereof, of course, the shielding shell 12' and the supporting bracket 13' are called a metal unit too. The alignment wall 103' defines at least one hole 107' for receiving a pair of hooks 125', 135' of a bent portion 124', 133' of the metal unit, and the bent portion 133' of the supporting bracket 13' defines a pair of protect walls 136'*a*, 136*b*' abut against opposite sides of the alignment wall 103' to increase strength of the alignment wall of the receptacle connector.

Alternatively, the mating opening 126 may be other interface such as USB interface. The bent portions benefit the strength of the mating ports at said condition that the receptacle connector has a plurality of the mating portions resulting in a longer length of the insulting housing and shell.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector assembly comprising:

a receptacle connector including:

an insulative housing having a base portion;

a plurality of terminals retained in the insulative housing; and a metal unit assembled on the insulative housing, the metal unit comprising a pair of sidewalls opposite to each other and forming a mating cavity therebetween;

the insulative housing further including an alignment wall extending into the mating cavity from the base portion to partition the mating cavity into a number of mating openings, one of the mating openings having a shape different from another;

wherein at least one of the sidewalls of the metal unit has an interlock extending from a front edge thereof to engage with the alignment wall of the insulative housing.

2. The electrical connector assembly as described in claim 1, wherein the interlock includes a bent portion bent from a front edge of the metal unit and a hook at a distal end of the bent portion for retaining in the alignment wall of the insulative housing.

3. The electrical connector assembly as described in claim 1, wherein the insulative housing has two tongue portions extending forward from the base potion, and each of the tongue portions defines a plurality of passageways thereon for arranging a contact portion of the terminal.

4. The electrical connector assembly as described in claim 1, wherein the alignment wall defines a first side-face and a second side-face, and only the second side-face defines a slant portion.

5. The electrical connector assembly as described in claim 3, wherein the metal unit includes a shielding shell, and said sidewall is provide by the shielding shell, the second side-face of the alignment wall and the sidewall of the shielding shell form a HDMI opening together, and said slant portion of the second side-face protrudes toward the HDMI opening.

6. The electrical connector assembly as described in claim 1, wherein the base portion defines a concavity and forming a mounting surface therein, the shielding shell has a pair of endwalls integrally connecting the sidewalls, and each endwall defines a solder portion.

7. The electrical connector assembly as described in claim 2, wherein a pair of the bent portions extends from said pair of sidewalls respectively, and each of the bent portions has an associated hook at the distal end thereof and secured in at least one hole of the alignment wall respectively.

8. The electrical connector assembly as described in claim 2, wherein the bent portion of the metal unit defines a pair of protect walls abutting against opposite sides of the alignment wall.

9. The electrical connector assembly as described in claim 7, wherein the two hooks of the bent portions are secured in the same hole of the alignment wall.

10. The electrical connector assembly as described in claim 1, wherein the metal unit includes a shielding shell and a supporting bracket attached to the shielding shell, and the supporting bracket defines a bent portion with a hook at the distal end thereof for fastening the alignment wall of the insulative housing.

11. The electrical connector assembly as described in claim 10, wherein the bent portion of the supporting bracket defines a pair of protect walls along the alignment wall extending into the mating opening from two sides of the bent portion respectively.

12. The electrical connector assembly as described in claim 1, further including a mating connector defining at least two mating portions adapted to be received the mating opening of the receptacle connector, respectively; and one of the mating portions has a different interface from another.

13. The electrical connector assembly as described in claim 12, wherein the mating connector includes a pair of locking arms on both sides thereof, a pair of buttons corresponding to the pair of locking arms for pushing the locking arm respectively and a cover covering the mating portion.

14. The electrical connector assembly as described in claim 13, wherein the button is formed by cutting a C-shape slit in both sides of the cover.

15. An dual-port receptacle connector, comprising:

an insulative housing defining a receiving space therein;

a partition formed in the receiving space dividing the receiving space into first and second mating ports;

a first mating plate with a plurality of first contact terminals arranged within the first cavity;

a second mating plate with a plurality of second contact terminals arranged within the second cavity;

a metallic shell assembled to the housing and including a planar base portion covering a top wall of the housing, and having an anchor securely attached to the partition.

16. An electrical connector comprising:

an insulative housing defining a vertical partition wall dividing first and second mating ports by two sides thereof under condition that said first and second mating ports communicate with an exterior in front-to-back direction;

a first mating tongue extending horizontally in said first mating port;

a second mating tongue extending horizontally in said second mating port;

a plurality of first contacts exposed on the first mating tongue;

a plurality of second contacts exposed on the second mating tongue;

a metallic shell enclosing said housing while exposing said first and second mating ports to the exterior; wherein said shell includes a locking device set retained to the partition wall.

17. The electrical connector as claimed in claim 16, wherein one of said first and second mating ports is confined by corresponding side wall of the housing in a outwardly lateral direction perpendicular to said front-to-back direction.

18. The electrical connector as claimed in claim 16, wherein said first and second mating ports are directly confined by corresponding top and bottom walls of the shell in a vertical direction perpendicular to both said front-to-back direction and said lateral direction.

19. The electrical connector as claimed in claim 18, wherein said locking device set includes upper and lower anchors respectively extending from said upper wall and said bottom wall of the shell.

20. The electrical connector as claimed in claim 16, wherein said locking device set fastened to the partition wall in the front-to-back direction.

* * * * *